US006390192B2

(12) United States Patent
Doesburg et al.

(10) Patent No.: US 6,390,192 B2
(45) Date of Patent: May 21, 2002

(54) INTEGRAL WELL FILTER AND SCREEN AND METHOD FOR MAKING AND USING SAME

(75) Inventors: James M. Doesburg, Des Moines; Michael D. Lubrecht, Carnation, both of WA (US)

(73) Assignee: Well, Well, Well, Inc., Des Moines, WA (US)

( * ) Notice: Subject to any disclaimer, the term of this patent is extended or adjusted under 35 U.S.C. 154(b) by 0 days.

(21) Appl. No.: 09/052,876

(22) Filed: Mar. 31, 1998

(51) Int. Cl.[7] ..... E21B 43/08
(52) U.S. Cl. ..... 166/230; 166/236
(58) Field of Search ..... 166/228, 230, 166/236, 227, 50; 175/61; 210/315, 484, 485, 400

(56) References Cited

U.S. PATENT DOCUMENTS 2,335,558 A * 11/1943 Young ..... 166/157

(List continued on next page.)

OTHER PUBLICATIONS

Lubrecht, Mike, *Vermeer Enviornmental Reference Manual*: Environmental HDD Applications, Vermeer Manufacturing, Inc., Pella, Iowa, 1998, pp. 1–7.

*Porex Products*, Porex Corporation, http://www.porex.com/Technologies/Products.html, (Nov. 14, 1997).

*Horizontal Directional Drilling Services for Environmental Remediation*, Directed Technologies Drilling, Inc., http://www.accessone.com/~dtd1/index.html (Aug. 18, 1997).

Frequently Asked Questions about Horizontal Directional Drilling for Environmental Remediation, Direct Technologies Drilling, Inc., http://www.accessone.com/~dtd1/FAQs.html, (Aug. 18, 1997).

Remediation Technologies Compatible with HDD, Directed Technologies Drilling, Inc., http://www.accessone.com/~dtd1/compatible.html, (Aug. 18, 1997).

All About the Horizontal Directional Drilling Process, Directed Technologies Drilling, Inc., http://www.accessone.com/~dtd1/drillhow.html, (Aug. 18, 1997).

Lubrecht, Mike, Vermeer Environmental Reference Manual: Well Performance and Casing Selection for Horizontal Wells, Vermeer Manufacturing, Inc., Pella, Iowa, 1998, pp. 1–9.

*Primary Examiner*—David Bagnell
*Assistant Examiner*—Jong-Suk Lee
(74) *Attorney, Agent, or Firm*—Perkins Coie LLP

(57) ABSTRACT

An integral well filter and screen and a method for making and using it are described. A first embodiment includes a perforated cylindrical well screen with a filter assembly in its interior. The filter assembly includes a pliable filter material bonded to a filter support. The filter support is a plastic lattice rigid enough to hold the shape of the filter assembly and keep the filter material in contact with the inner surface of the well screen, yet deformable enough that the filter assembly can be formed into a shape consistent with the interior of the well screen. A second embodiment includes a well screen with a filter made of a rigid, porous material placed inside the well screen. Because the filter is rigid, it needs no filter support. Methods of manufacturing each of the embodiments are presented. For the first embodiment, the method includes bonding the filter support to the filter material; forming the filter assembly into a cylindrical shape complementary to the inner surface of the well screen; securing abutting edges of the filter assembly to maintain its shape and rigidity, and ensure complete filtration, and inserting the filter assembly into the well screen. The manufacture of the filter in the second embodiment is similar, but does not include the bonding of a filter support to the rigid, porous material. Finally, a method of installing the filter and screen in a horizontal well is presented.

3 Claims, 7 Drawing Sheets

U.S. PATENT DOCUMENTS 2,342,913 A * 2/1944 Williams et al. ..... 166/230
2,600,150 A * 6/1952 Abendroth ..... 210/314
2,837,032 A * 6/1958 Horsting, Sr. ..... 166/227
2,981,332 A * 4/1961 Miller et al. ..... 166/228
2,985,241 A 5/1961 Hanslip
3,033,783 A * 5/1962 Lubben ..... 29/517
3,201,858 A * 8/1965 Valyi ..... 29/423
4,102,395 A * 7/1978 Robinson ..... 166/231
4,182,414 A 1/1980 Sanders et al.
4,445,574 A * 5/1984 Vann ..... 166/268
4,583,594 A * 4/1986 Kojicic ..... 166/228
4,779,682 A 10/1988 Pelzer
4,811,790 A 3/1989 Jennings, Jr. et al.
5,004,049 A 4/1991 Arterbury
5,133,864 A * 7/1992 Vaughn et al. ..... 210/437
5,232,048 A * 8/1993 Whitebay et al. ..... 166/236 X
5,279,362 A 1/1994 Pool
5,293,935 A * 3/1994 Arterbury et al. ..... 166/228
5,318,119 A 6/1994 Lowry et al.
5,339,895 A 8/1994 Arterbury et al.
5,355,949 A 10/1994 Sparlin et al.
5,394,938 A 3/1995 Cornette et al.
5,411,084 A * 5/1995 Padden ..... 166/230
5,411,090 A 5/1995 Cornette et al.
5,415,227 A 5/1995 Jennings, Jr.
5,509,483 A 4/1996 Graen
5,515,915 A 5/1996 Jones et al.
5,551,513 A 9/1996 Surles et al.
5,597,045 A * 1/1997 Sass et al. ..... 175/62
5,823,260 A * 10/1998 McConnell et al. ..... 166/230
5,899,271 A * 5/1999 Simone et al. ..... 166/230
5,901,789 A * 5/1999 Donnelly et al. ..... 166/230 X
5,937,944 A * 8/1999 Simone et al. ..... 166/230
5,992,518 A * 11/1999 Whitlock ..... 166/236 X
6,006,829 A * 12/1999 Whitlock et al. ..... 166/228
6,012,512 A * 1/2000 Donnelly et al. ..... 166/227 X Lubrecht, Michael, Horizontal Wells Tilt Industrial Site Pollutant: Multiple Challenges Spawn Innovative Solutions, Soil and Groundwater Cleanup, Wavelinx Publishing Co., 1995, 1–2.

* cited by examiner

INTEGRAL WELL FILTER AND SCREEN AND METHOD FOR MAKING AND USING SAME

TECHNICAL FIELD

The present invention pertains to well casings used in well drilling applications, and in particular to an integral well filter and screen used as a casing in horizontal wells, and methods for making and using same.

BACKGROUND OF THE INVENTION

Wells generally are either vertical or horizontal. Vertical wells are more commonly known, but in certain applications horizontal wells have several advantages. Environmental site remediation, i.e., the removal of subsurface contamination or inplace treatment of zones of soil or groundwater contamination, is one area where horizontal wells are superior to vertical ones. Reasons for the superiority of horizontal wells include increased linear footage of the well in contact with the contaminated zone, and the ability to drill beneath surface obstructions or existing sites without the disturbing ongoing operations at the site. A horizontal well may be either single-ended or double-ended. In a single-ended well, one end of the well is at the ground surface and the other is below ground; this is also known as a "blind hole." In a double-ended completion, both ends of the well are at the ground surface.

Completing a horizontal well usually involves two phases: drilling a well bore and installing a casing. Drilling begins with digging a launch pit at the point where the drill head will be inserted into the ground and, if it is a double-ended well, digging an exit pit where the drill head will emerge from the ground. The drill head has a transmitter therein which broadcasts a signal that enables the operator to determine its exact location, and is controlled and steered either remotely through radio signals from a control unit or directly through input provided through wires inside the drill, rods. The drill head is inserted into the ground at the launch pit and drilling begins. The operator guides the drill head downward to the desired depth, horizontally for the desired length of the well, and, if it is a double-ended well, upward to the exit pit. Different and more complex well structures, for example with several horizontal portions at different depths and orientations, are also possible.

Installing the casing is the second part of the well completion. The casing is a generally tubular member whose functions include keeping the well bore from caving in and transporting contaminants to the surface once the well is operating. The casing usually consists of a perforated well screen through which liquids and gases can enter and leave the well screen, and may include a means of filtration coupled thereto. The installation method will depend on whether the well is single-ended or double-ended. In a double-ended well, the drill head pulls behind it a drill string while it is guided from the launch pit to the exit pit; when the drill head emerges at the exit pit, the drill string emerges with it. A well casing is attached to drill string and the drill string is pulled from the exit pit back toward the launch pit, pulling the casing with it back through the well bore. In a single-ended well, the drill head is removed from the well bore when the drilling is complete and the casing is then pushed into the well bore through the launch pit. In either case, movement of the casing through the well bore may be facilitated using a lubricant such as drilling mud or guar-gum fluid. If a well screen is fragile, it can be installed using a carrier casing. After the well bore is drilled, it is reamed out and a solid casing with an inner diameter larger than the outside diameter of the well screen is installed. The well screen is placed within and pulled through the carrier casing. The carrier casing is then removed, leaving the well screen in place. Carrier casings make the installation expensive.

Despite their advantages, horizontal wells present special installation and operation problems that vertical wells do not. Horizontal well casings are subject to higher stresses and have a higher potential for damage during installation than vertical wells of similar dimensions. Stresses in a vertical casing tend to be low and only become a problem if the wells are very deep, so that gravitational forces acting on the casing are large. By contrast, horizontal casings are subjected to higher tensile forces because of frictional forces between the casing and the well bore and because of stress concentration in the casing as it bends to conform to turns in the well bore. Frictional forces on the casing are more pronounced in horizontal wells because the weight of the casing pulls it into contact with the lower part of the well bore. Stress concentrations are higher in horizontal casings because more force must be applied to overcome the friction and because of bending stresses induced in the casing when it is forced to conform to turns in the well bore that are characteristic of horizontal wells. Furthermore, horizontal well casings may be required to resist crushing forces that result if the well bore collapses onto the casing. In addition to experiencing higher stresses, horizontal casings are also more likely to receive abrasion damage from the sides of the well bore as the casings are pushed or pulled through the well bore.

Aside from installation problems, the most pronounced operational difference between vertical and horizontal wells is the increased tendency of soil, sand, and other fine particulate matter to enter the well casing through perforations in the well screen. Over long periods of time, particulate matter in the casing can lead to clogging of the well, damage to pumping equipment connected to the casing at the surface, and a variety of other problems. The usual way of dealing with this problem in vertical wells is to apply a filter pack to the casing. The orientation of the well casing in a horizontal well makes application of a filter pack more difficult.

In a vertical well, the well casing is held at or near the center of the well bore using a type of spacer known as a centralizer. Loose sand is distributed around the well casing to form a natural filter pack, with the sand gradation and slot size of the screen being chosen to provide the appropriate filtering. Natural filter packs have been unsuccessful in horizontal wells because it is difficult to create a sand pack completely surrounding the casing, numerous centralizers must be used to support the weight of the horizontal casing; the centralizers cause drag and high forces on the casing during installation.

Three main types of filter packs have been tried on horizontal wells with varying degrees of success. The simplest is the "natural pack," which essentially is a well screen with no filter at all. The natural pack can work quite well, depending on the use of the well and the grain size of the soil. If, however, the application is one that is prone to sedimentation, such as a groundwater extraction well, the natural pack does not work as well. Or, if it is used in an injection well, it can become silted or sanded if the operation of the well is cycled or temporarily suspended.

The next type of filter pack used on horizontal wells is the field constructed filter, also known as a "field wrap." The usual way of doing this is to wrap some form of non-woven filter material around the outside of the well screen. This method provides extra filtration, but can be expensive and time consuming, especially in the field. The filter material is robust, but it tends to increase the frictional drag between the well bore and the casing during installation. If a snag occurs during installation, the casing may break or the filtration material may become dislodged, leaving gaps through which soil can enter the screen.

The third type of filter pack is the integrated filter pack, and these come in two varieties. The first uses a synthetic well screen with wide slots and is covered with an external, tubular composite of filtration materials. The composite consists of a layer of fine, medical-grade synthetic mesh sandwiched between two layers of heavier mesh, and is installed on the well screen with heat shrink tubing bonded to the ends. Installation of this type of filter pack in a horizontal well bore is difficult due to the poor bonding of the filter to the base pipe, and therefore usually requires a carrier casing for installation. The second variety of integrated filter pack consists of a porous filter screen made of sintered polyethylene resin beads. The porous construction of the filter screen, however, limits its tensile strength and makes a carrier casing a requirement for installation.

SUMMARY OF THE INVENTION

The present invention is a well casing comprising an integral well filter and screen for use in well installations and a method for making and using the casing. One embodiment includes a well screen with a filter placed in an internal volume of the screen. The well screen is typically made of high-density polyethylene and has therein a plurality of perforations to allow fluid communication between the inside of the well screen and the outside. The well screen can be manufactured to any length. The filter includes a pliable filter material to which is bonded a substantially rigid but deformable filter support that keeps the filter material in contact with an inner surface of the well screen. The first embodiment is manufactured by bonding the filter support to the filter material, forming the filter assembly into a shape that fits into the internal volume and keeps the filter material in engagement with an inner surface of the well screen, inserting the filter assembly into the internal volume, and securing the assembly therein.

A second embodiment also has a well screen with an internal filter, but in this embodiment the filter is made of a substantially rigid material so that it needs no filter support. Instead, the filter material is simply formed into a cylindrical shape corresponding to the interior dimension of the well screen, joined at the abutting edges, and inserted inside the well screen as is the first embodiment.

The embodiments of the invention solve several of the problems of the prior art. Because the filter is inside the well screen, filter damage during insertion of the screen into the well bore is eliminated or substantially reduced. Putting the filter inside the screen and using a pliable filter material with a filter support bonded thereto result in a thinner cross section that allows the screen to bend easily when it goes around corners in well bores. The configuration also allows better tailoring of the stiffness of the combination to the application, has excellent hydraulic performance, is more durable, and costs half as much as present screen/filter casings.

DETAILED DESCRIPTION OF THE INVENTION

An integral well filter and screen for use as a well casing in a horizontal well is described herein in reference to specific embodiments. In the following description, numerous specific details are set forth to provide a thorough understanding of the present invention. One skilled in the relevant art, however, will readily recognize that the present invention can be practiced without one or more of the specific details reflected in the embodiments described herein.

Figure 1A:
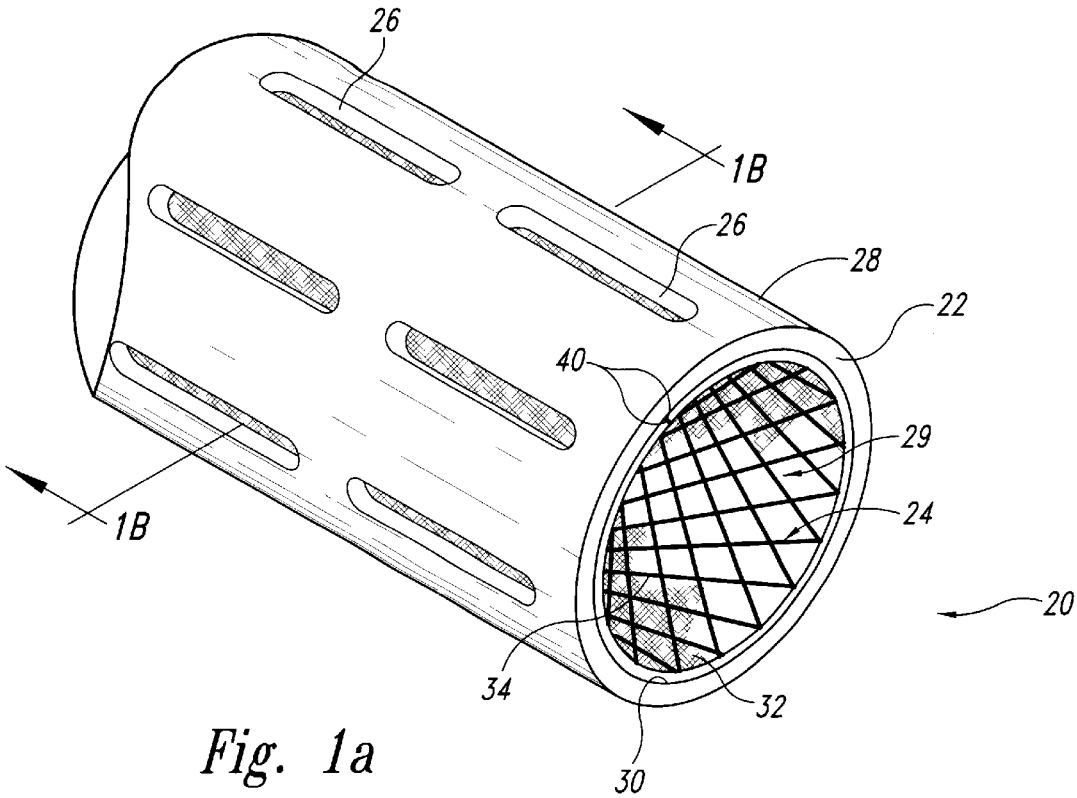
FIG. 1*a* is an isometric view of a first embodiment of an integral well filter and screen.

FIG. 1*a* shows a first embodiment of an integral well filter and screen having as its main components a well screen 22 and a filter assembly 24 positioned within the well screen. The well screen 22 is made from a length of pipe and has therein a series of perforations 26. The pipe typically has a diameter between 2 and 8 inches and comes in 10 or 20 foot sections, but the well screen 22 can be made to any length by fusing together several sections of pipe, by cutting the desired length of pipe from a single section, or both. High-density polyethylene (HDPE) pipe sold under trade names such as Phillip Petroleum Driscopipe or Chevron Plexco is most often used, but the pipe can be made of any material suitable for the application; other possible pipe materials include polyvinyl chloride, fiberglass reinforced epoxy, carbon steel, and stainless steel.

The perforations 26 are shown as longitudinal slots in the well screen 22 but may be of any shape suitable for the application, including longitudinal slots, longitudinal slits, transverse slots or slits, circles, squares, or any combination of these or others. The perforations 26 extend from the exterior surface 28 of the well screen 22 through to the interior surface 30 of the well screen 22, allowing fluid communication between an internal volume 29 of the well screen 22 and its exterior. The perforations 26 are sized based on the required tensile strength of the well screen and the open area required to treat the soil contamination. Typical diameters for round perforations are between 1/16 and ½ inches. Longitudinal slots are typically 1½ inches long with a width between ⅛ and ⅜ inches. Transverse slits typically remove 60% of the crosssectional area of the well screen at the longitudinal position where they are located.

The filter assembly 24 resides in an internal volume 29 of the well screen 22 and is sized and shaped so as to conform to the shape of the interior surface 30 and remain in engagement therewith. The filter assembly 24 includes a pliable filtration material 32 and a filter support 34 bonded to one side of the filtration material 32.

Figure 1B:
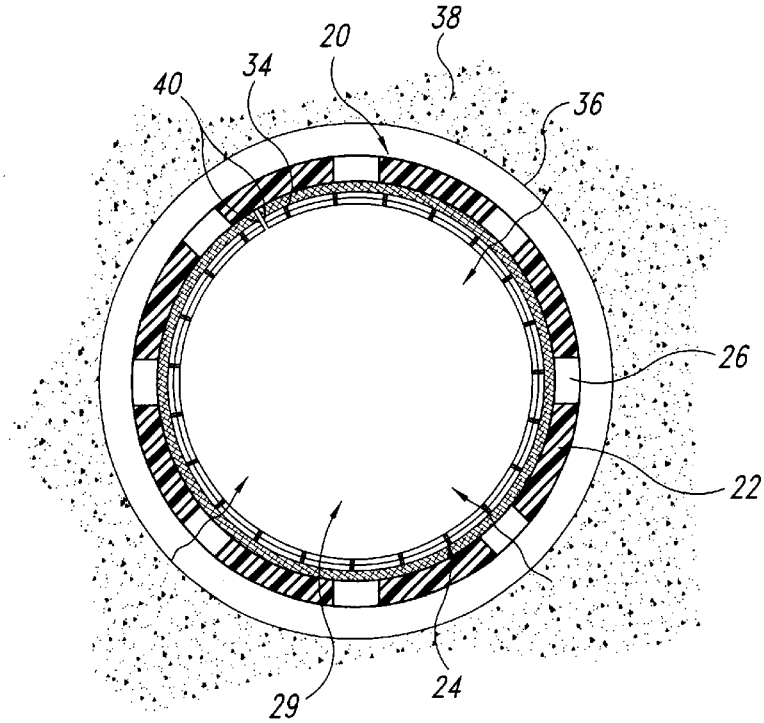
FIG. 1*b* is a cross section of the first embodiment taken substantially through the line 1B—1B in FIG. 1*a* and showing the filter and screen installed in a well bore.

FIG. 1*b* shows a cross-section of the first embodiment of the integral filter and screen 20 installed inside a well bore 36 and illustrates its operation. Once installed, the integral well filter and screen 20 is used for removal of liquids and gases from the surrounding soil 38 or insertion of liquids and gases into the surrounding soil 38. In a typical application, air is pumped out of the casing by a pump (not shown) attached to the casing at the ground surface, thus pulling liquids or gases from the surrounding soil 38 through the perforations 26 and into the interior volume 29 of the well filter and screen, as shown schematically by the wavy arrows in FIG. 1*b*. The filter assembly 24 allows the entry of liquids and gases into the internal volume 29 while keeping soil, sand, and other fine particulate matter from entering.

Figure 2A:
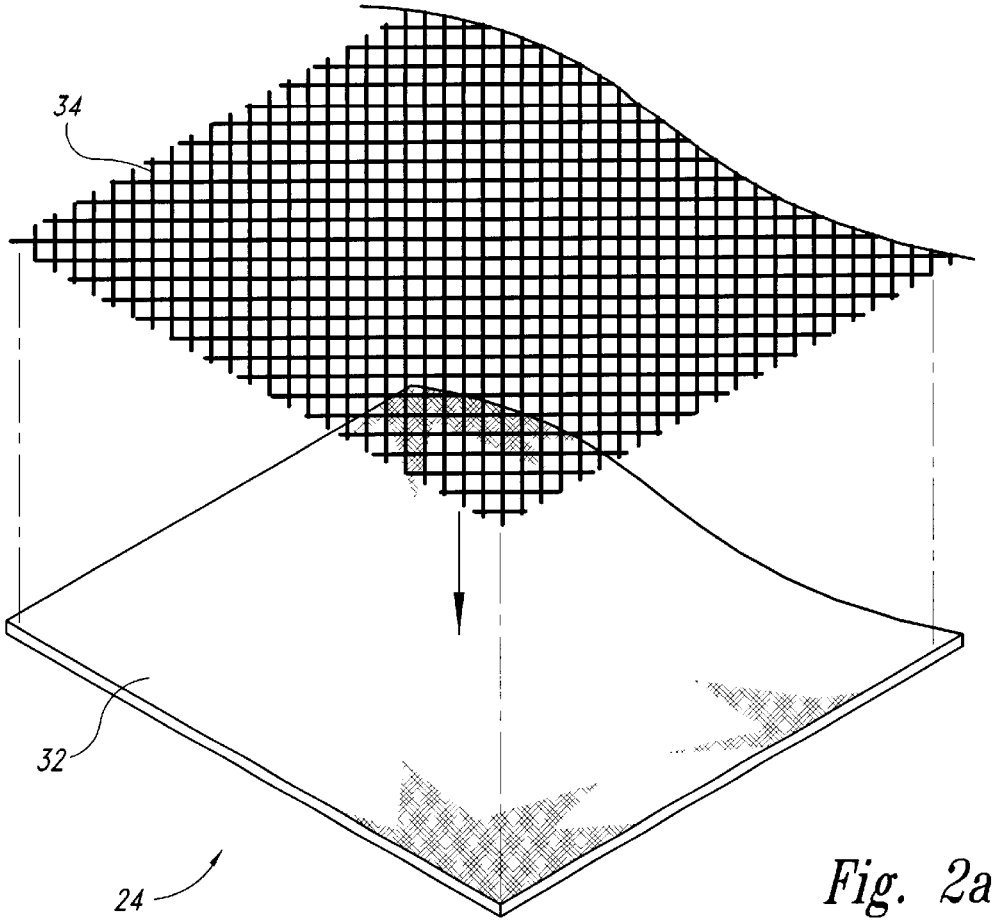
FIGS. 2*a*–2*d* illustrate the structure of a filter in the first embodiment and, in sequence, illustrate a method of manufacturing the first embodiment.

FIGS. 2*a*–2*d* illustrate the structure of the first embodiment of the integral well filter and screen 20 and, taken in sequence, illustrate its method of manufacture. FIG. 2*a* illustrates the construction of the filter assembly 24, which includes the filtration material 32 bonded to the filter support 34. The filtration material is typically a non-woven material such as DuPont® Trevira, but may be any material capable of filtration. The filtration material is chosen based on the required apparent opening size, which depends directly on the thickness of the material; typical thicknesses range between 1/16 and 1/4 of an inch. The filter support used in this embodiment is a high-density polyethylene lattice that is rigid enough to hold the shape of the filter assembly once it is inserted in the internal volume 29 of the well screen 22, yet flexible enough that the filter assembly 24 can be formed into a shape that conforms to the interior surface 30 of the well screen 22. The filter support is typically purchased from the manufacturer of the filtration material and comes pre-bonded to the material. For example, DuPont® Trevira comes from the factory with the HDPE lattice already bonded thereto. Although typically made of HDPE, the filter support can also be made in a variety of configurations and materials. For example, it could be a PVC lattice or a stainless steel mesh or lattice.

Figure 2B:
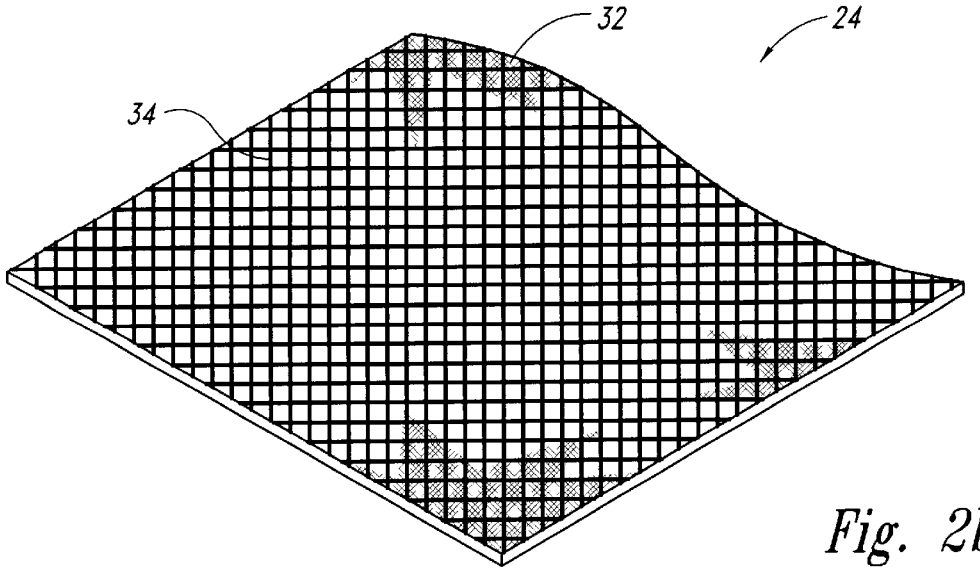
Figure 2C:
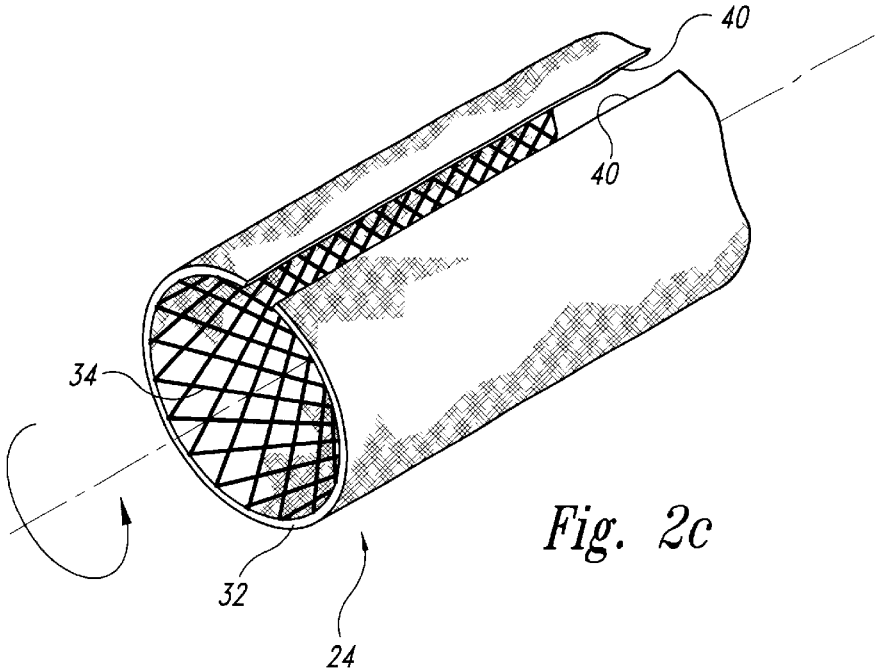
Figure 2D:
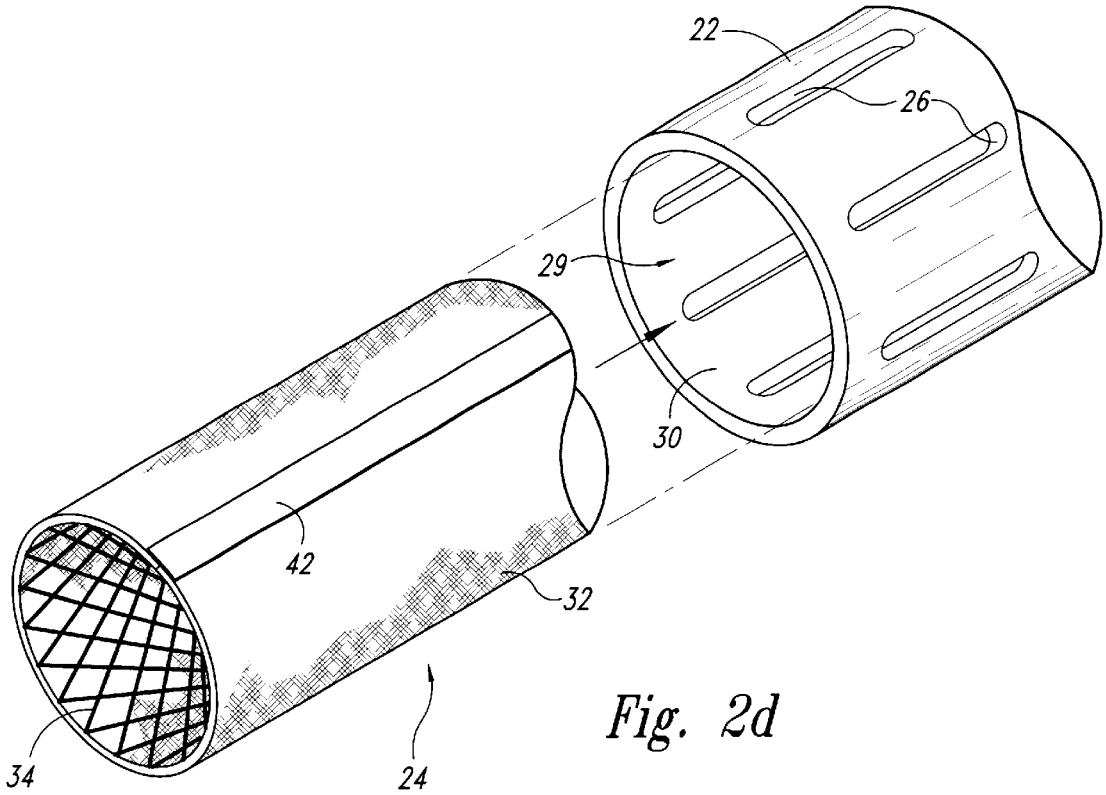

FIG. 2*b* shows the filter assembly 24, the filter support 34 having been fused or thermally bonded to the filtration material 32. In FIG. 2*c*, the filter assembly 24 is formed into a cylindrical shape such that two edges 40 are abutting each other. A strip 42 of filtration material (FIG. 2*d*) about 2 inches wide is placed over the abutting edges 40 to hold the cylindrical shape of the filter assembly 24, increase its strength and rigidity, and ensure complete filtration around the circumference of the filter. FIG. 2*d* shows the filter assembly 24, once in the proper shape, being inserted into the internal volume 29 of the well screen 22. The size of the filter assembly 24 is such that, once it is placed in the internal volume 29, the filtration material 32 will be in engagement with the interior surface 30 of the well screen 22.

Figure 3A:
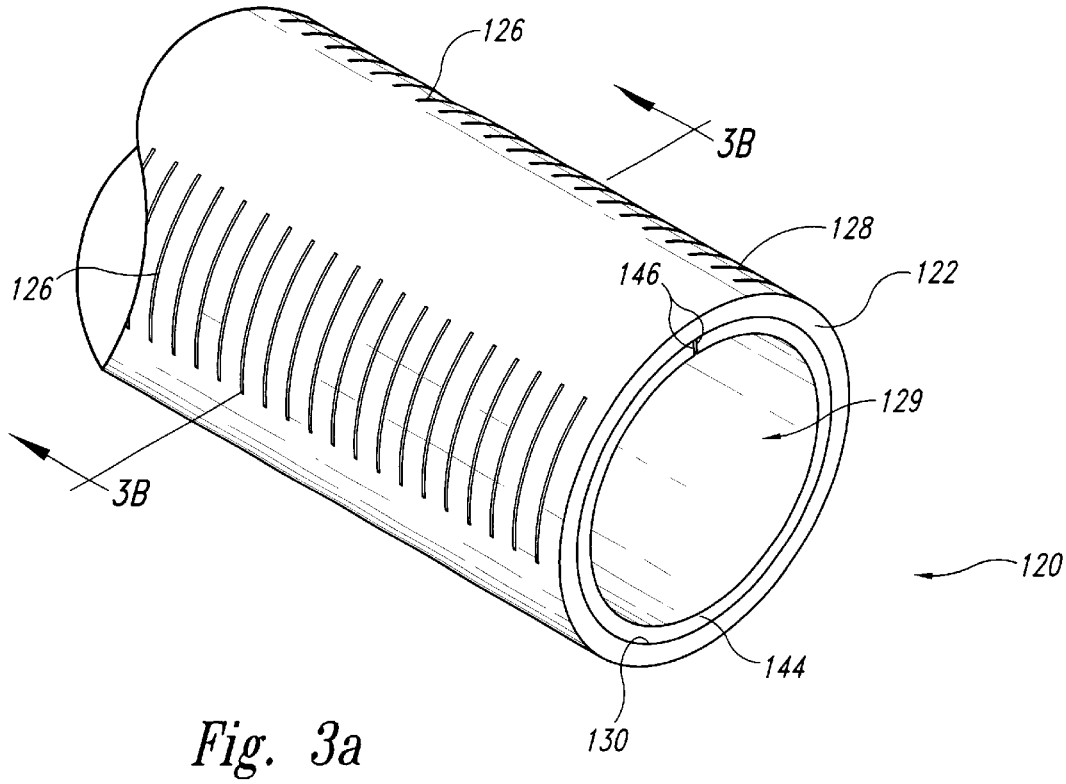
FIG. 3*a* is an isometric view of a second embodiment of an integral well filter and screen.'

FIG. 3*a* shows a second embodiment of the well filter and screen 120 that includes the well screen 122 having perforations 126 as before, although in this embodiment they are transverse slits rather than longitudinal slots. In this embodiment, the filter 144 is made of a rigid, porous material rather than a pliable filtration material bonded to a filter support. As with the first embodiment, the filter 144 fits within the internal volume 129 of the well screen 122 and engages the interior surface 130 of the well screen 122.

Figure 3B:
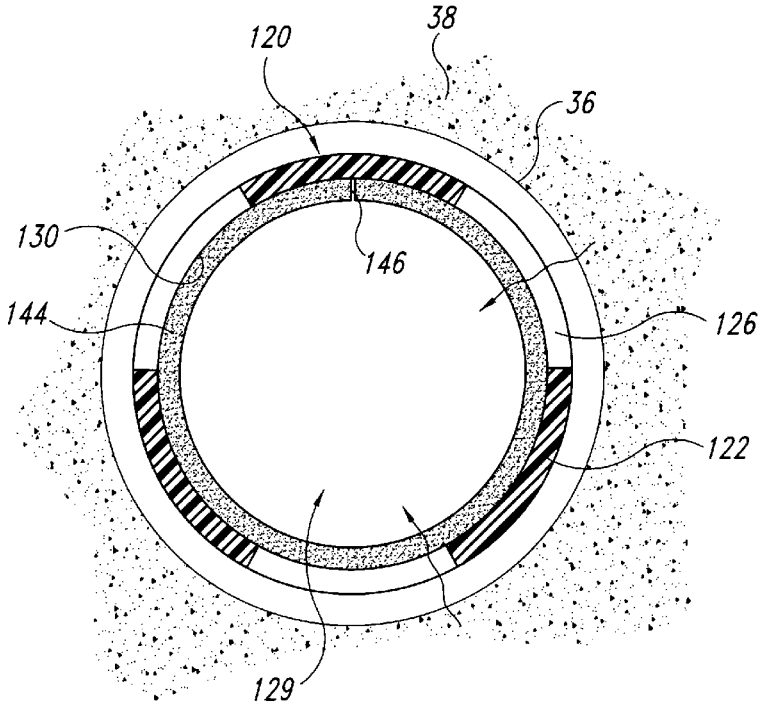
FIG. 3*b* is a cross section of the second embodiment taken substantially through line 3B—3B in FIG. 3*a* and showing the filter and screen installed in a well bore.

FIG. 3*b* illustrates the operation of the second embodiment, which is much like the operation of the first embodiment described above. Once the well bore 36 is drilled, the integral well filter and screen 120 is inserted therein. In a typical application, air is pumped out of the interior volume 129 of the well screen 122 by a pump (not shown) located on the surface of the ground. As shown schematically by the wavy arrows in FIG. 3*b*, the porous filter 144 allows liquids and gases from the surrounding soil 38 to move into the internal volume 129 and be pumped out to the ground surface, while preventing the entry of sand, soil, and other fine particulate matter into the internal volume 129. Over the long term, this filtration prevents accumulation of particulate materials in the well screen, prevents damage to the pumps at the surface of the ground, and avoids various other problems.

Figure 4A:
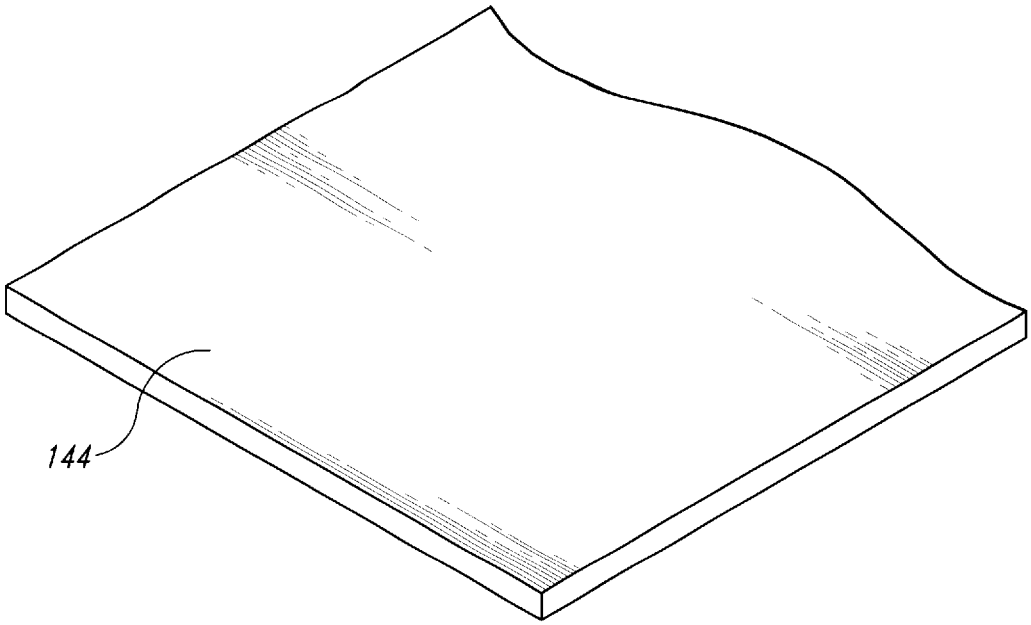
FIGS. 4*a*–4*c* illustrate the structure of the filter in the second embodiment and, in sequence, illustrate a method of manufacturing the second embodiment.
Figure 4B:
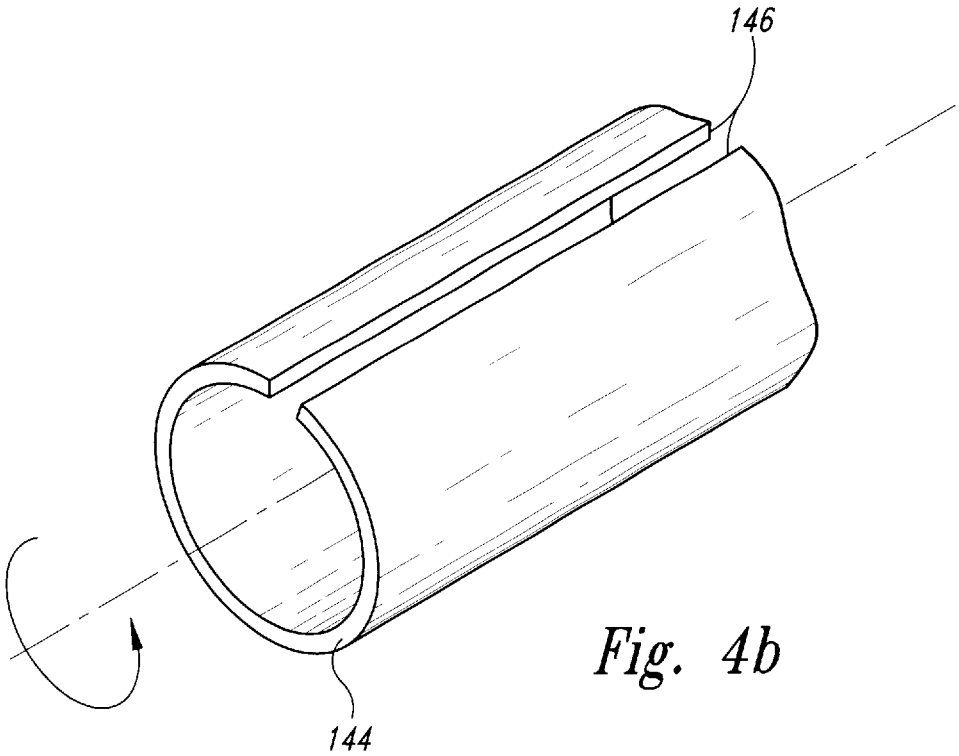
Figure 4C:
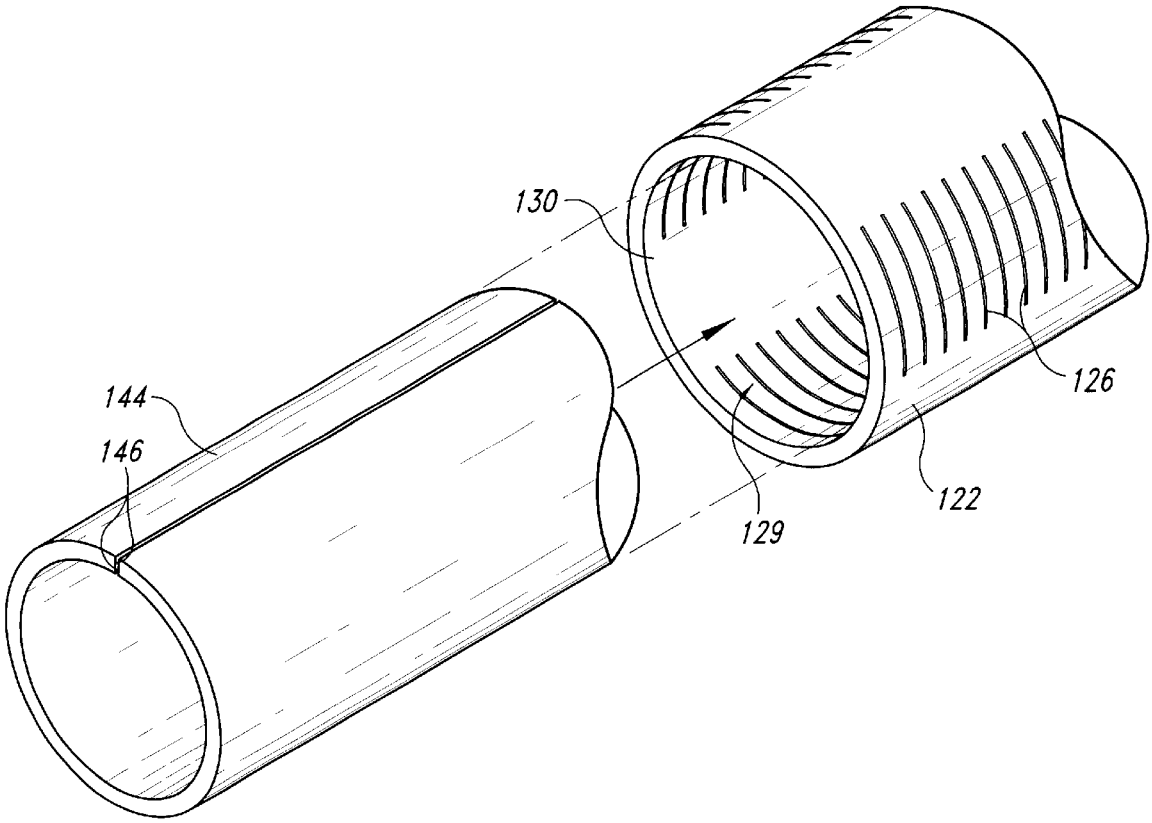

FIGS. 4*a*–4*c* illustrate the structure of the second embodiment and a method of manufacture. FIG. 4*a* illustrates the substantially rigid, porous material 144 in an initial state. Typically, the rigid, porous material is between 1/16 and 1/4 inch thick and is made of sintered polyethylene beads. Its porosity is controlled by varying the heat and pressure applied during sintering. The most commonly used rigid porous materials are any of the porous plastics made by Porex® Corporation. The rigid porous material 144 is formed into a cylindrical shape as shown in FIG. 4*b* until the abutting edges 146 are nearly in contact with each other. As with the first embodiment, the filter is sized and shaped to fit in the internal volume 129 of the well screen 122, with the filter 144 engaging the interior surface 130 of the well screen 122. FIG. 4*c* illustrates the insertion of the filter 144 into the internal volume 129 of the well screen 122. The filter 144 is aligned in the internal volume 129 such that the abutting edges 146 are not aligned with any perforations, thus ensuring complete filtration. In a second method of manufacture (not shown), the filter 144 is initially formed into its final cylindrical shape and then simply inserted in the interior volume 129 of the well screen 122.

Figure 5A:
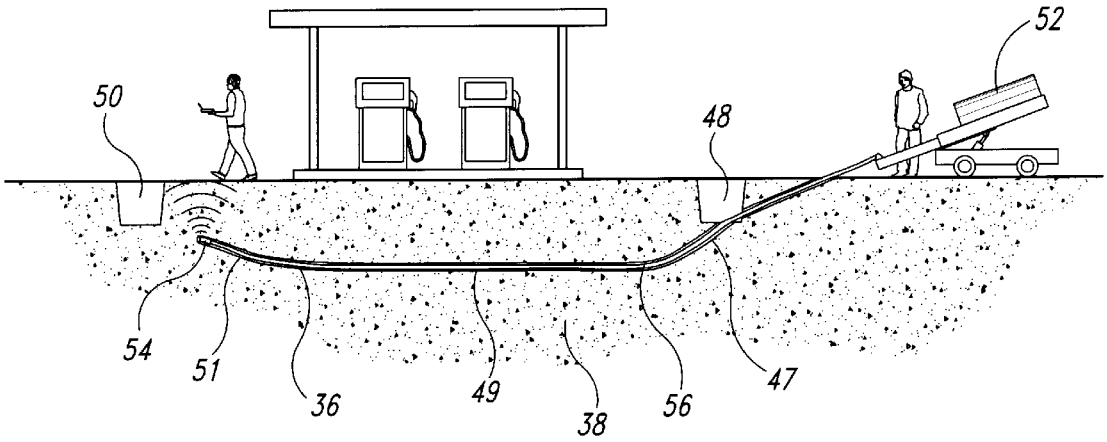
FIGS. 5*a*–5*b* are cross sections through a typical double-ended horizontal well illustrating the method of drilling a well and installing a casing.
Figure 5B:
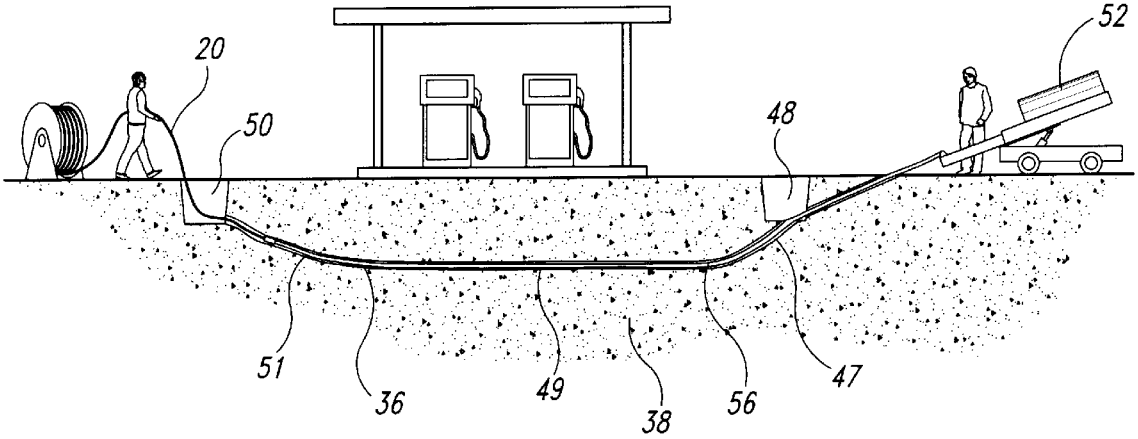

FIGS. 5*a* and 5*b* illustrate a method of drilling a double-ended horizontal well and installing the integral well screen and filter 20 or 120. FIG. 5*a* shows the drilling process. An entrance pit 48 and an exit pit 50 are dug at the desired entry and exit positions, respectively, of the drilling head; these are usually located on either side of the remediation zone. Using a directional drilling unit 52, a drill head 54 is inserted into the entrance pit 48 and begins drilling the well bore. The path of the drill generally includes at least three portions: a downwardly directed portion 47, a substantially horizontal portion 49, and an upwardly directed portion 51. Different and more complex configurations are possible, such as wells having multiple horizontal portions at different depths below the surface and multiple upwardly and downwardly directed portions. The drill head is controlled by an operating using either a remote control that sends signals to the drill head, or using signals sent to the drill head through wires attached thereto. As the drill head drills the well bore, it pulls behind it a drill string 56. When the drill head 54 arrives at the exit pit 50 it is pulled out of the ground along with the drill string 56.

FIG. 5*b* shows the casing installation. Once the drill head 54 has arrived at the exit pit 50, it is removed from the well bore. If necessary, the well bore can be reamed to increase its size. The drill string is connected to the well filter and screen 20 or 120. A lubricant such as guar-gum fluid is pumped into the well bore and the directional drilling unit 52 pulls the drill string 56 and the filter and screen 20 back through the well bore 36 until the filter and screen extend between the exit pit 50 and the entrance pit 48. Any desired hardware, such as pumps (not shown), can then be attached to the ends of the filter and screen at the ground surface.

The process illustrated in FIGS. 5*a* and 5*b* is for a double-ended well. In a single-ended well (not shown), the end of the well bore is underground rather than at an exit pit 50. To get a single-ended well, an entrance pit 48 is dug at the desired location. The directional drilling unit inserts the drill head 54 into the entrance pit, drills the well bore 36 to the desired location, and pulls the drill head 54 back out through the well bore. At that point, a lubricant is pumped into the well bore and a well filter and screen 20 or 120 with its blind end capped is pushed through the entrance pit into the completed well bore until it extends between the entrance pit and the end of the well bore.

Although specific embodiments of, and examples for, the present invention are described herein for illustrative purposes, various equivalent modifications are possible within the scope of the invention, as will be recognized by those skilled in the relevant art. The teachings provided herein of the present invention can be applied to other integral well filters and screens and method for making and using the same, not necessarily the exemplary well filter and screen described above. In general, in the following claims, the terms used should not be construed to limit the invention to the specific embodiments disclosed in the specification and the claims, but should be construed to include all integral well filters and screens that operate under the claims and provide a method for making and using the integral well filter and screen. Accordingly, the invention is not limited by the disclosure, but instead its scope is to be determined entirely by the following claims.

What is claimed is:

1. A well filter system to filter a fluid flow, comprising:

a well screen comprising an external wall having an inner surface, an outer surface, and a plurality of perforations extending from the outer surface to the inner surface to allow a fluid to pass through the wall, wherein the well screen comprises a pipe and the perforations comprise holes in the pipe;

a filter member having an inner surface and an outer surface, the filter member being in the well screen so that the outer surface of the filter member is against the inner surface of the external wall such that portions of the filter member are exposed through the perforations at the outer surface of the well screen, wherein the filter member is configured relative to the well screen so that the fluid flow passes firstly through the perforations in the well screen and secondly through the filter member, wherein the filter member comprises a sheet of polymeric material; and a filter support attached to the inner surface of the filter member, the filter support being a biasing member that exerts an outward radial force against the filter member, wherein the filter support comprises a flexible mesh.

2. A well filter system to filter a fluid flow, comprising:

a well screen comprising an external wall having an inner surface, an outer surface, and a plurality of perforations extending from the outer surface to the inner surface to allow a fluid to pass through the wall, wherein the well screen comprises a pipe and the perforations comprise holes in the pipe;

a filter member having an inner surface and an outer surface, the filter member being in the well screen so that the outer surface of the filter member is against the inner surface of the external wall such that portions of the filter member are exposed through the perforations at the outer surface of the well screen, wherein the filter member is configured relative to the well screen so that the fluid flow passes firstly through the perforations in the well screen and secondly through the filter member, wherein the filter member comprises a sheet of polymeric material; and a filter support attached to the inner surface of the filter member, the filter support being a biasing member that exerts an outward radial force against the filter member, wherein the filter support comprises a flexible mesh composed of high-density polyethylene.

3. A well filter system to filter a fluid flow, comprising:

a well screen comprising an external wall having an inner surface, an outer surface, and a plurality of perforations extending from the outer surface to the inner surface to allow a fluid to pass through the wall, wherein the well screen comprises a pipe and the perforations comprise holes in the pipe;

a filter member having an inner surface and an outer surface, the filter member being in the well screen so that the outer surface of the filter member is against the inner surface of the external wall such that portions of the filter member are exposed through the perforations at the outer surface of the well screen, wherein the filter member is configured relative to the well screen so that the fluid flow passes firstly through the perforations in the well screen and secondly through the filter member, wherein the filter member comprises a sheet of non-woven material rolled to fit within the pipe; and a filter support attached to the inner surface of the filter member, the filter support being a biasing member that exerts an outward radial force against the filter member, wherein the filter support comprises a high-density polyethylene mesh bonded to a polymeric sheet, the high-density polyethylene mesh biasing the polymeric sheet against the inner surface of the wall.

* * * * *